US009561541B2

(12) United States Patent
Wagstaff et al.

(10) Patent No.: US 9,561,541 B2
(45) Date of Patent: Feb. 7, 2017

(54) SUPPORT AND COMPRESSION ASSEMBLIES FOR CURVILINEAR MOLTEN METAL TRANSFER DEVICE

(71) Applicant: Novelis Inc., Atlanta, GA (US)

(72) Inventors: Robert Bruce Wagstaff, Greenacres, WA (US); Eric W. Reeves, Hayden Lake, ID (US); Richard Allen Wayment, Chattaroy, WA (US); Richard Scott Bruski, Spokane, WA (US); Randal Guy Womack, Spokane Valley, WA (US)

(73) Assignee: Novelis Inc., Atlanta, GA (US)

( * ) Notice: Subject to any disclaimer, the term of this patent is extended or adjusted under 35 U.S.C. 154(b) by 0 days.

(21) Appl. No.: 14/834,323

(22) Filed: Aug. 24, 2015

(65) Prior Publication Data

US 2016/0052053 A1 Feb. 25, 2016

Related U.S. Application Data

(60) Provisional application No. 62/040,694, filed on Aug. 22, 2014.

(51) Int. Cl.

| | |
|---|---|
| ***B22D 35/00*** | (2006.01) |
| ***F27D 1/00*** | (2006.01) |
| ***F27D 27/00*** | (2010.01) |
| ***F27B 3/04*** | (2006.01) |

(52) U.S. Cl.

CPC ..... *B22D 35/00* (2013.01); *F27B 3/04* (2013.01); *F27D 1/0026* (2013.01); *F27D 27/00* (2013.01)

(58) Field of Classification Search

CPC ..... B22D 35/00; B22D 41/00; F27D 1/0026; F27D 27/00

USPC ..... 266/285, 235, 236, 239, 196, 275; 164/437, 335; 222/591, 590, 594; 432/252; 138/155

See application file for complete search history.

(56) References Cited

U.S. PATENT DOCUMENTS

| | | | | |
|---|---|---|---|---|
| 4,531,717 | A | 7/1985 | Hebrant | |
| 8,158,055 | B2 | 4/2012 | Takahashi | |
| 2011/0074072 | A1* | 3/2011 | Rauch | C22B 21/0084 266/166 |
| 2011/0140318 | A1 | 6/2011 | Reeves et al. | |
| 2011/0140322 | A1* | 6/2011 | Reeves | B22D 41/00 266/275 |

FOREIGN PATENT DOCUMENTS

| | | | |
|---|---|---|---|
| GB | 2104633 | A | 3/1983 |
| WO | 2011130825 | A1 | 10/2011 |

OTHER PUBLICATIONS

International Patent Application No. PCT/US2015/046573, International Search Report and Written Opinion mailed Dec. 10, 2015, 10 pages.

* cited by examiner

*Primary Examiner* — Scott Kastler
*Assistant Examiner* — Michael Aboagye
(74) *Attorney, Agent, or Firm* — Kilpatrick Townsend & Stockton LLP

(57) ABSTRACT

A curvilinear metal transfer device with support and compression assemblies that help maintain a constant force on the transfer device's metal outer casing and refractory as the outer casing and refractory expand and contract due to temperature fluctuations. In one embodiment, the support assemblies are configured to apply force to the refractory to keep the refractory in tension with the outer casing to suspend the refractory relative the outer casing. Also disclosed are clamp plates that help hold the refractory in place, and nested lids that cover the curvilinear metal transfer device.

19 Claims, 15 Drawing Sheets

SUPPORT AND COMPRESSION ASSEMBLIES FOR CURVILINEAR MOLTEN METAL TRANSFER DEVICE

CROSS REFERENCE TO RELATED APPLICATIONS

The present application claims the benefit of U.S. Provisional Application No. 62/040,694 filed on Aug. 22, 2014 and entitled "SUPPORT AND COMPRESSION ASSEMBLIES FOR CURVILINEAR MOLTEN METAL TRANSFER DEVICE," which is hereby incorporated by reference in its entirety.

FIELD OF THE INVENTION

This application relates to support and compression assemblies for use with curvilinear devices for containing, stirring and/or conveying molten metal.

BACKGROUND

To form a metal ingot, which is metal material cast into a suitable shape for use in various applications, metal is heated past its melting point in a furnace. Typically, the molten metal is composed of two or more materials and therefore it is important that the molten metal be sufficiently mixed to produce an ingot having a uniform structure.

Molten metal may be routed out of the furnace or other structure, mixed thoroughly, and routed back into the furnace or other structure to mix the molten metal before it solidifies. In some cases, the molten metal flows out of the furnace and back into the furnace along a curvilinear or other shaped metal transfer structure. As the molten metal moves through the metal transfer structure, the molten metal is agitated and therefore mixed. In some applications, mixing occurs using magnetic fields, such as is taught by U.S. Pat. No. 8,158,055, which issued on Apr. 17, 2012 and is incorporated herein by reference.

The described curvilinear metal transfer structures can be used in any suitable application and with any desired structure. As one additional non-limiting example, a metal transfer structure can be used to connect a furnace to a separate structure to facilitate the conveyance of molten metal between the furnace and the separate structure.

One non-limiting example of a curvilinear metal transfer structure includes a refractory housed within an outer metal casing. The molten metal, as well as combustion gases, flames and other high temperature materials, contact the refractory and therefore the refractory must have a high melting point and otherwise be capable of withstanding the high temperatures of the molten metal. The refractory insulates the outer metal casing from the molten metal to help prevent the operating temperature of the outer metal casing from reaching unsafe levels. An air gap and/or insulation may be provided between the outer metal casing and the refractory.

The refractory in contact with the molten metal typically becomes extremely hot and in some cases reaches temperatures of around 750° C., and combustion gases can heat the surface of the refractory in excess of 1200° C. Transfer of heat from the refractory to the outer metal casing causes the metal casing to heat to high temperatures during operation. As temperatures at the outer casing and the refractory change, the two components expand and contract. If the components expand and/or contract at uneven rates, distortion may occur, which can cause gaps from which the molten metal may leak. Moreover, because of the curvilinear nature of the metal transfer structure, the inner wall of the refractory is shorter than the outer wall of the refractory and thus expands less than the outer wall as the refractory heats up. Similarly, the inner wall of the outer casing is shorter than the outer wall of the outer casing and thus expands less than the outer wall as the outer casing heats up. The dissimilar heating of the inner walls versus the outer walls creates a mechanical puzzle that must be solved so that, as the refractory heats and expands, the outer casing can remain dynamic and retain its structural integrity over multiple heating and cooling cycles.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

This patent discloses a curvilinear metal transfer device with various support and compression assemblies that help maintain a constant force on the curvilinear metal transfer device's metal outer casing and refractory as the inner and outer surfaces of the outer casing and refractory expand and contract due to temperature fluctuations and the significant stresses placed on the curvilinear metal transfer device as the materials heat up and cool down. In particular, the support and compression assemblies apply force to the refractory to keep the refractory in compression with the outer casing to suspend the refractory relative to the outer casing. In this way, the support and compression assemblies accommodate different expansion and contraction rates of the outer casing and the refractory by allowing for selective expansion and compression of the refractory relative to the outer metal casing.

BRIEF DESCRIPTION OF THE DRAWINGS

Illustrative embodiments of the present invention are described in detail below with reference to the following drawing figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Disclosed herein is an improved curvilinear metal transfer device for conveying molten metal into and out of a furnace or other structure. While the molten metal is conveyed through the curvilinear metal transfer device, the molten metal can be agitated to help achieve uniformity throughout the liquid. The curvilinear metal transfer device includes a plurality of support and compression assemblies that support a refractory within a metal casing. Specifically, the support and compression assemblies are configured to account for the fact that the refractory and the metal casing, and the inner and outer walls of the refractory and metal casing, do not expand and contract uniformly; therefore, the support and compression assemblies help maintain the structural integrity of the refractory and the casing.

Figure 1:
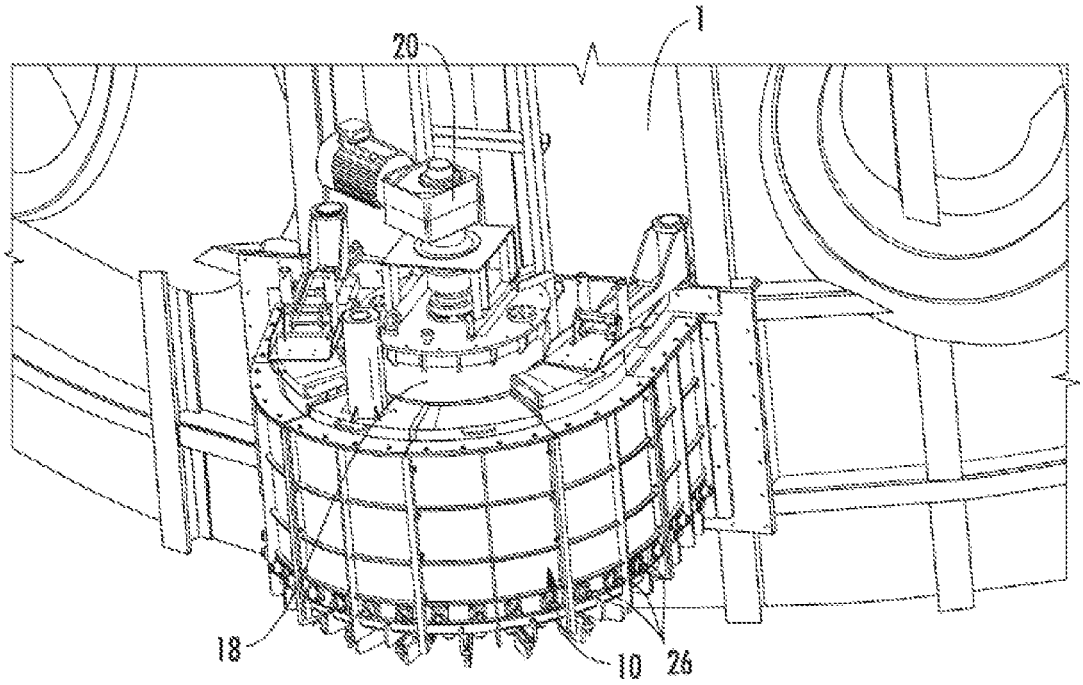
FIG. 1 is a top, rear perspective view of a curvilinear transfer device attached to a furnace.
Figure 6:
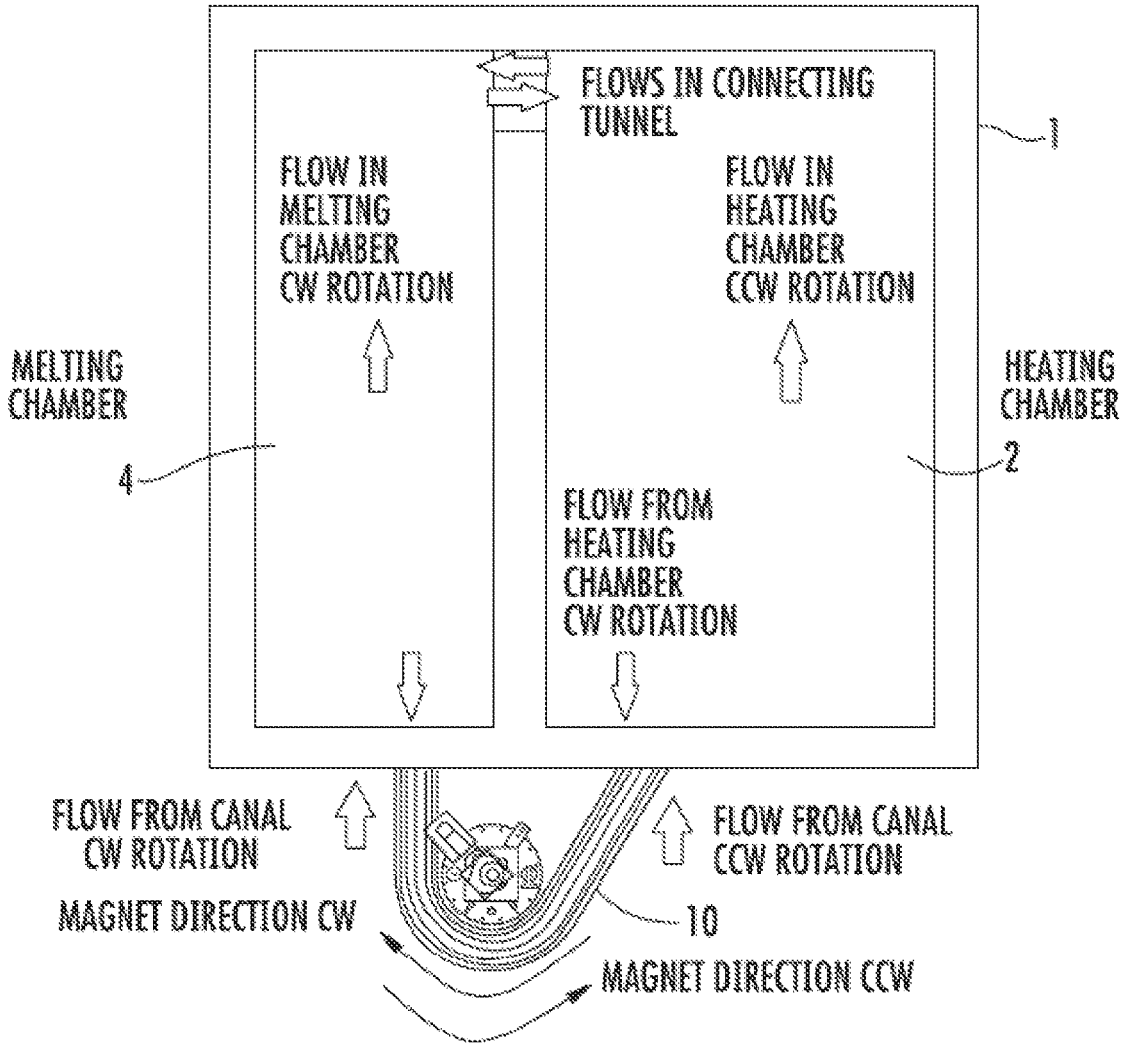
FIG. 6 is a schematic illustrating a curvilinear transfer device connecting two chambers of a furnace.
Figure 7:
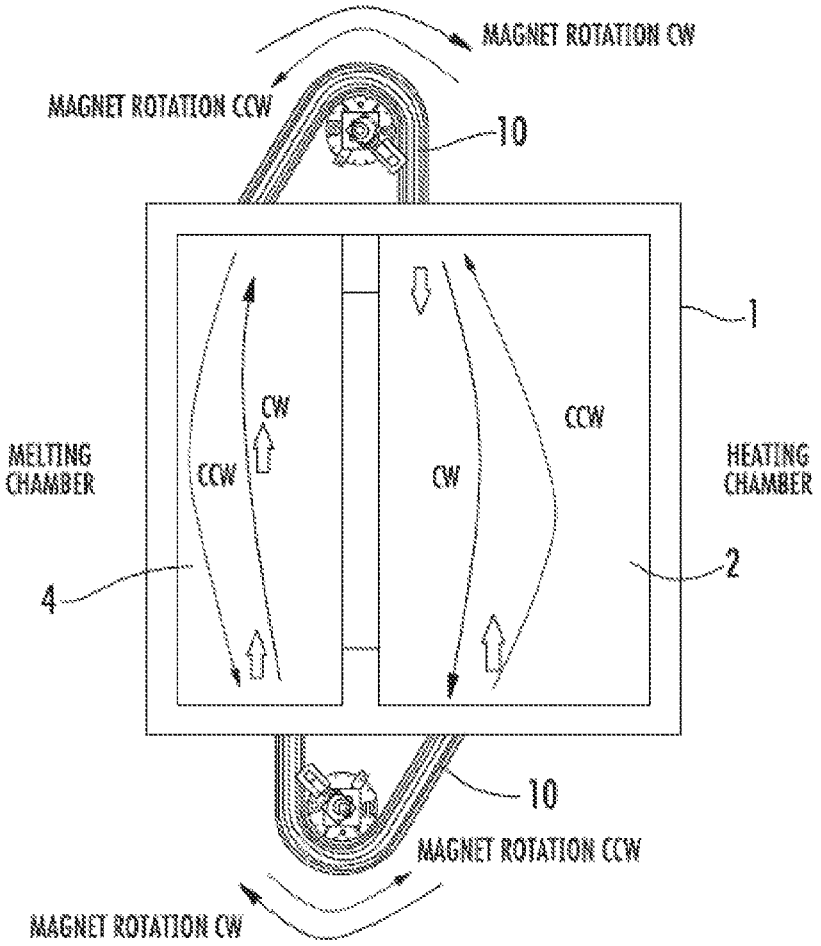
FIG. 7 is a schematic illustrating two curvilinear transfer devices connecting two chambers of a furnace.

FIG. 1 illustrates a curvilinear metal transfer device 10 that is bolted or otherwise suitably attached to a furnace or other structure, such as furnace 1 of FIG. 1 or FIGS. 6-7. As shown, the metal transfer device 10 is curvilinear, but the metal transfer device could have another configuration. In general, however, features herein are directed to structures for handling uneven thermal expansion rates for different surfaces of a metal transfer device. As shown in the embodiment of FIG. 2, molten metal may flow out of the furnace (or other suitable structure) at outlet 12, around a trough 14 of the metal transfer device 10, and back into the furnace (or other suitable structure) at inlet 16, or vice versa.

Furnace 1 may be a single chamber furnace or have more than one chamber. For example, as illustrated in FIGS. 6-7, one or more curvilinear metal transfer structures 10 may connect a heating chamber 2 and a melting chamber 4 of a furnace 1 such that molten metal can be transferred (and in some cases stirred) along the metal transfer structure 10 between the heating chamber 2 and the melting chamber 4, both of which having mixing means to promote heating and melting, respectively, of the metal. If two metal transfer structures 10 are used on opposite sides of the furnace 1, as illustrated in FIG. 7, a communicating flow circuit can be created to move the molten metal in a circular motion from the heating chamber 2 to the melting chamber 4 and again from the melting chamber 4 to the heating chamber 2.

Figure 2:
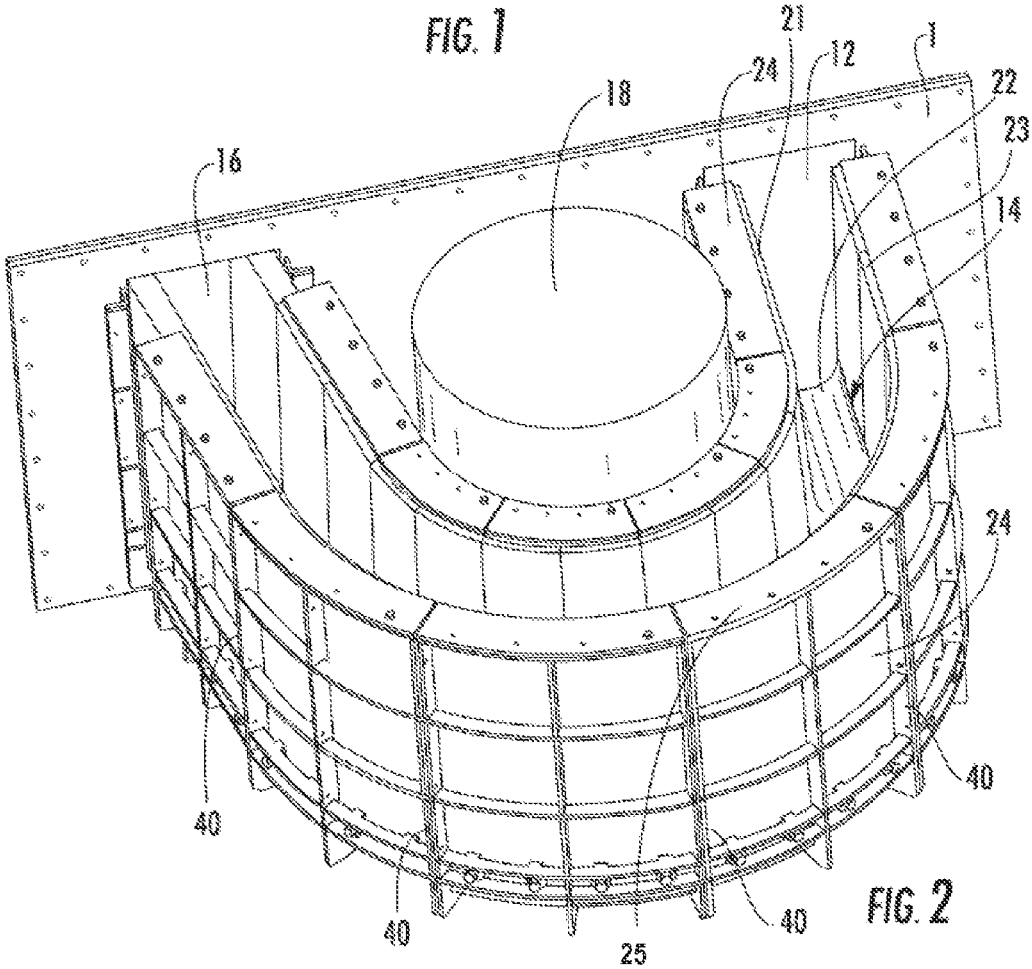
FIG. 2 is another top, rear perspective view of the curvilinear transfer device of FIG. 1.
Figure 3:
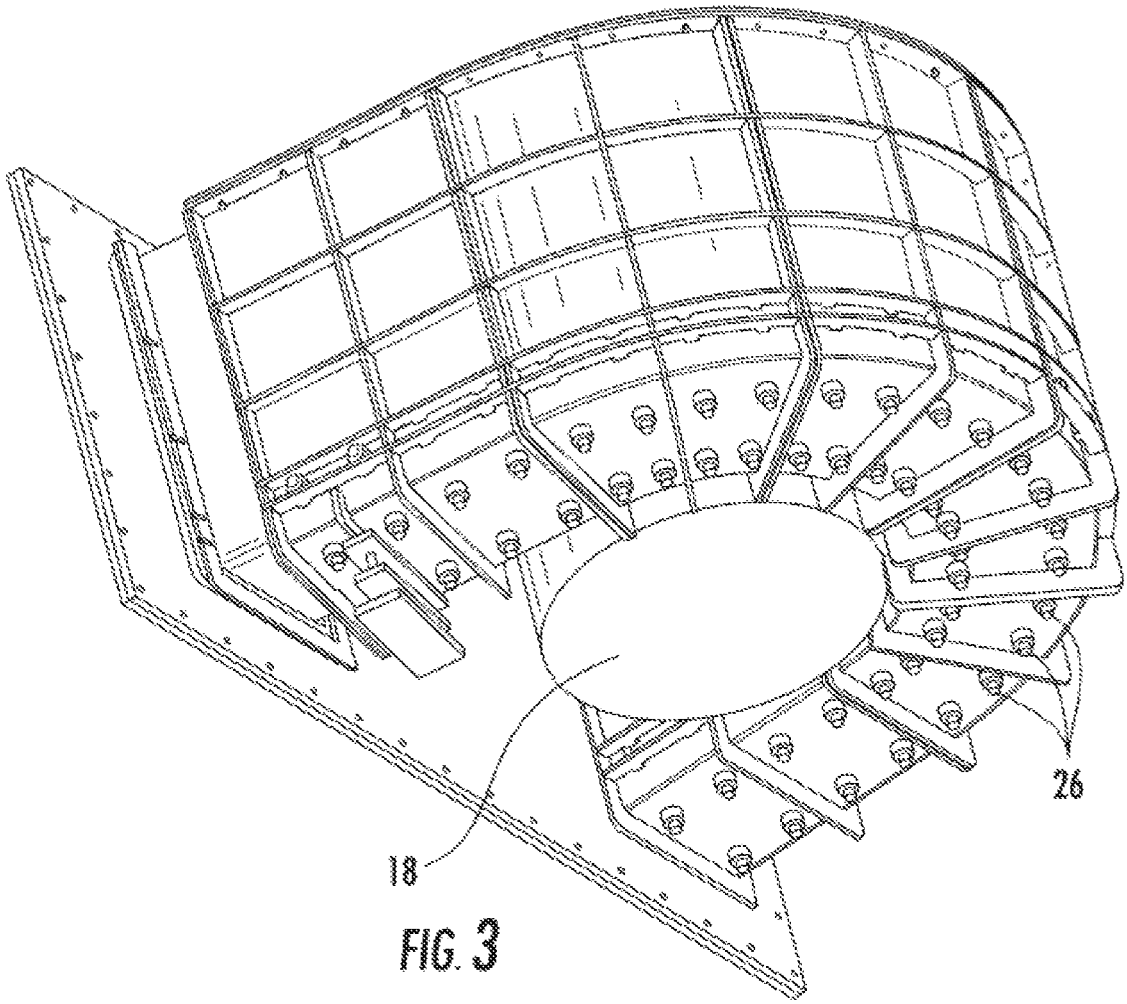
FIG. 3 is a bottom, rear perspective view of the curvilinear transfer device of FIG. 1.
Figure 4:
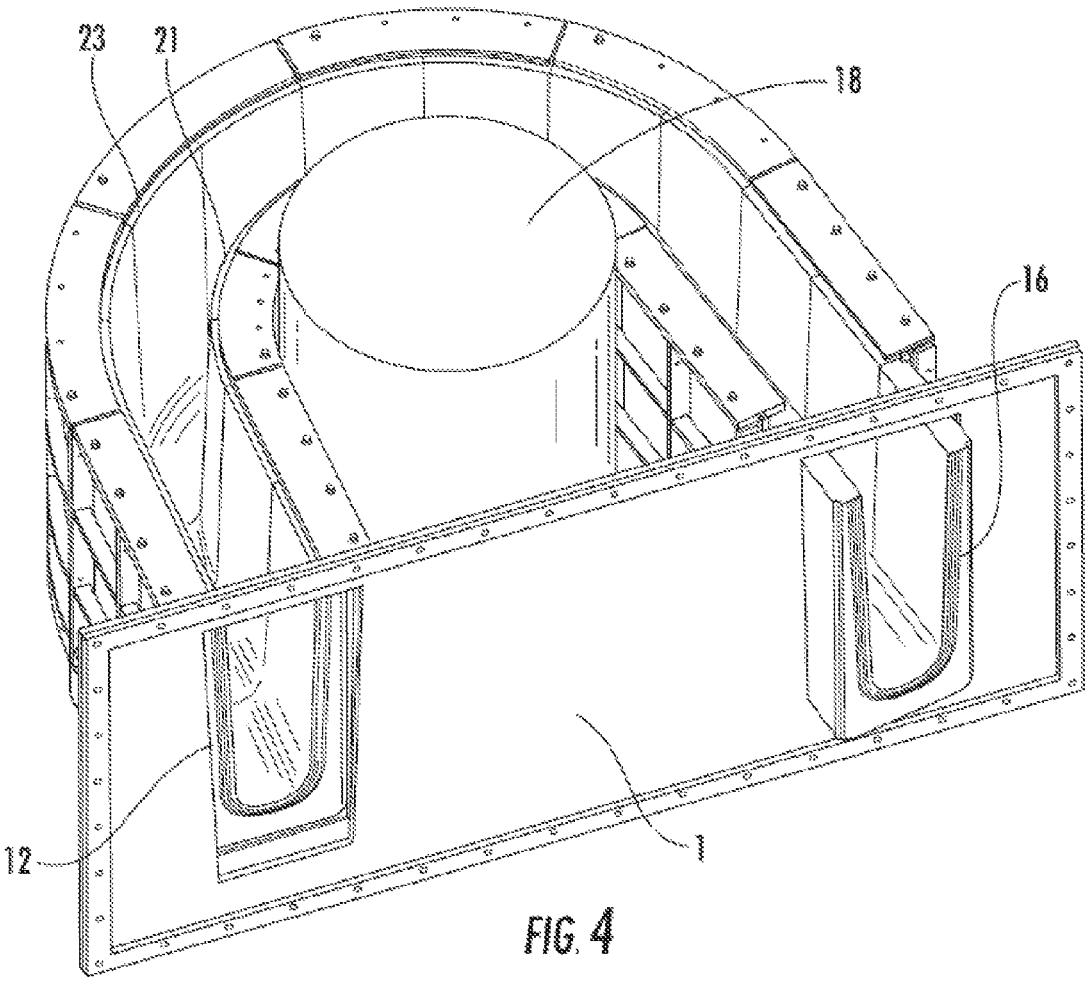
FIG. 4 is a top, front perspective view of the curvilinear transfer device of FIG. 1.

As shown in FIG. 2, trough 14 includes a refractory 22 that insulates an outer metal casing 24 from the high temperatures of the molten metal flowing through the trough 14. Refractory 22 includes an inner wall 21 and an outer wall 23 (FIGS. 2 and 4), where outer wall 23 is longer than inner wall 21 due to the curvilinear nature of trough 14. Similarly, outer casing 24 includes an outer wall that is longer than an inner wall of the outer casing. In some cases, the outer metal casing 24 is configured to hold the refractory 22 in place during heat up and thermal cycling of the molten metal. In non-limiting embodiments, the refractory is made of aluminum oxide or other suitable non-reactive, insulating material.

In embodiments, the molten metal can be agitated or otherwise mixed while the metal flows through the metal transfer device 10. For example, magnetic fields can be used to stir the molten metal. As an example, as shown in FIG. 1, a motor and gear box 20 cause a magnetic circuit 18 to rotate to generate a magnetic eddy current that penetrates the outer casing 24 and the refractory 22 and generates a radial flow in the molten metal in concert with the radial direction of the magnet in the metal transfer device 10, which in turn generates a flow and thus momentum that is sufficient to thoroughly mix the molten metal in the furnace as the molten metal exits the curvilinear metal transfer device 10. The refractory 22 and the outer metal casing 24 help shield operators working near the metal transfer device 10 from the magnetic fields generated by the magnetic circuit 18 and from the extreme temperatures of the molten metal.

A furnace such as furnace 1 is typically very large; in some cases it has an exterior diameter of around 40 feet and can hold around 125 tons of molten metal; however, furnaces of varying dimension and capacity are within the scope of this description, and the aforementioned dimensions are exemplary only and not intended to be limiting. Since the metal transfer device 10 is bolted or otherwise attached to the side of the furnace, the furnace will cause the outer metal casing with which it is in contact to expand and contract as the furnace heats up and cools back down. It is important that the metal transfer device 10 be able to expand and contract uniformly along the radial surface to maintain its structural integrity against the pressure and the corrosive nature of the molten metal while still being strong enough to withstand the heavy loads of the molten metal.

During operation of the furnace, the side of the refractory exposed to the molten metal typically has an average temperature of between 700-750° C., while the opposite side of the refractory (the side facing the metal casing) has a significantly lower temperature of around 400-500° C. During the melting cycle, various gases may bring the surface temperature of the refractory up to around 1200° C. If the temperature of the side of the refractory in contact with the metal casing is higher than the temperature of the outer casing, the metal casing will heat up. In this way, the temperature of the refractory 22 and the outer casing 24 is extremely dynamic.

Typically, the linear coefficient of expansion of the refractory 22 is different from the linear coefficient of expansion of the outer metal casing 24, which causes the refractory 22 to expand and contract at a different rate than the outer metal casing 24. Similarly, the relatively shorter curvilinear (e.g., arc-radial) inner wall 21 of the refractory 22 expands less than the relatively longer curvilinear outer wall 23 of the refractory. Gaps may form in either or both the refractory and the metal casing if the refractory does not expand and contract at the same rate as the outer metal casing and/or if the inner wall 21 of the refractory does not expand and contract at the same rate as the outer wall 23. If these cracks form, molten metal can leak and cause burn risks and other hazards. Along these same lines, if the refractory 22 and metal casing 24 heat and cool at different rates, one or both of the structures may buckle and be subjected to cracks or other structural defects, risking leakage of potentially high volumes of molten metal. The heat and cooling cycles are particularly destructive, as the forces during these cycles are even more significant than the forces associated with normal use.

Figure 5:
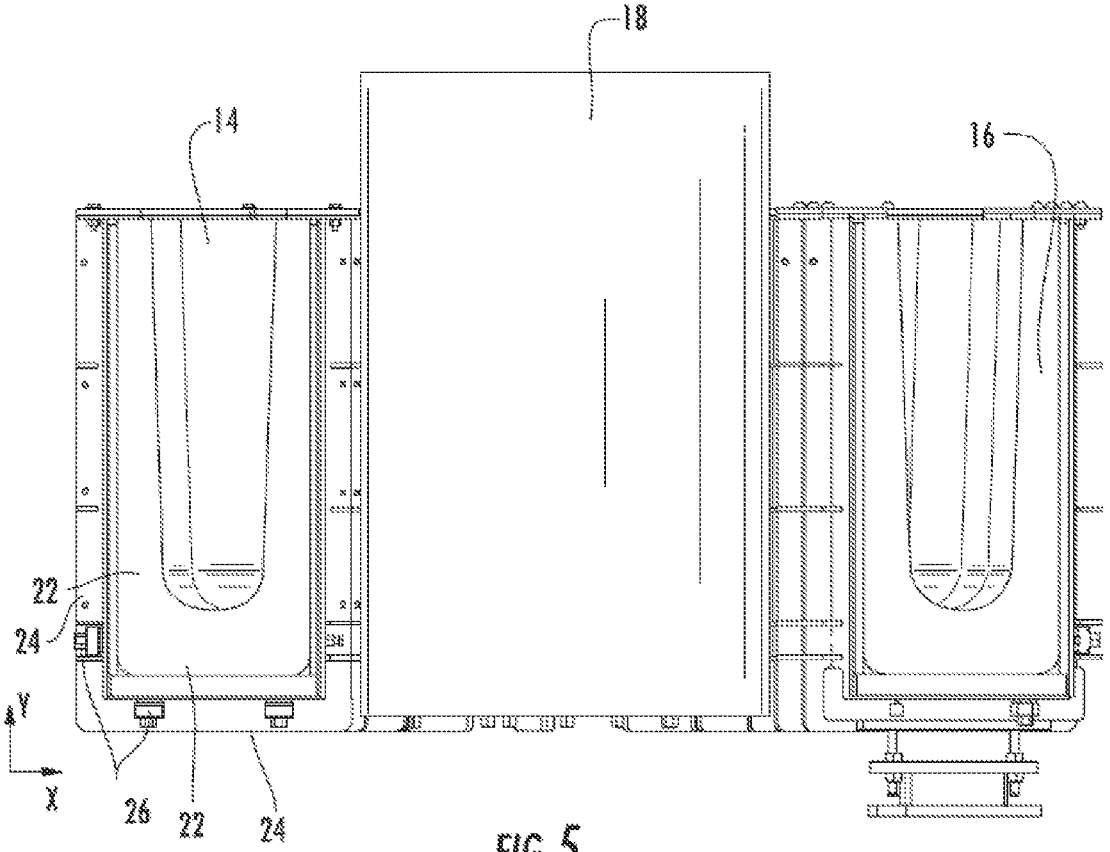
FIG. 5 is a section view of the curvilinear transfer device of FIG. 1.

To accommodate the different linear coefficients of expansion of the casing 24 and the refractory 22 while still providing the necessary support for the metal transfer device 10 to support large loads, support assemblies 26 are positioned radially along the metal transfer device 10 to suspend the refractory 22 away from the outer casing 24. As shown in FIG. 5, support assemblies 26 may be positioned between the outer casing 24 and the refractory 22 along both the x-axis and the y-axis. In this way, support assemblies 26 apply compressive forces to the refractory 22 to suspend the refractory 22 relative to the outer casing 24 in both the x and y directions.

Figure 8:
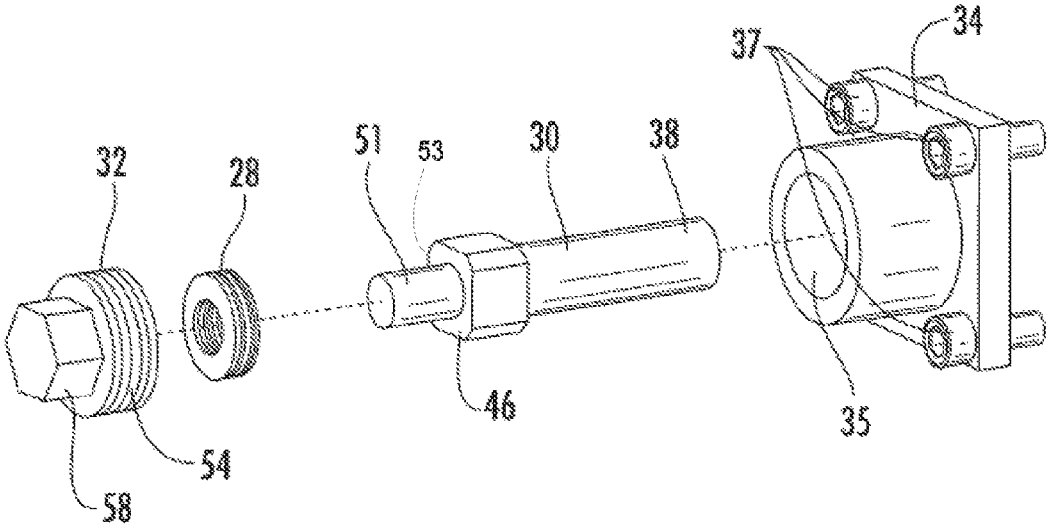
FIG. 8 is an exploded view of a support assembly according to one embodiment.
Figure 9:
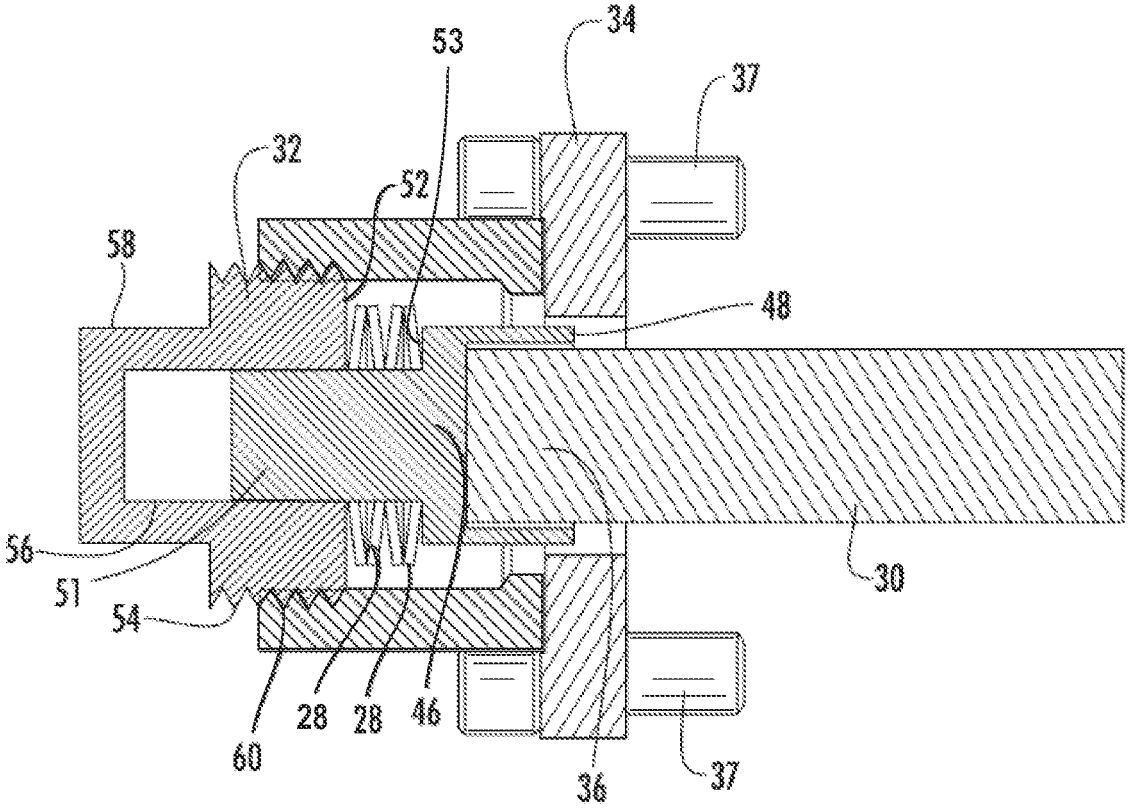
FIG. 9 is an assembled section view of the support assembly of FIG. 8.

As shown in FIGS. 8-9, each support assembly 26 can include a support assembly clamp plate 34, a push rod 30, one or more spring washers 28, a fastener 32 and a series of support assembly clamp plate fasteners 37. A cylindrical aperture 35 extends out of the proximal side of the support assembly clamp plate 34 and receives a distal end 38 of the push rod 30. The distal end 38 is anchored against the refractory 22. A proximal end 36 of the push rod 30 receives a cap 46. In some cases, the cap 46 and the push rod 30 can be formed as a single component, however in other cases and as seen in FIGS. 8-9, the cap 46 and the push rod 30 are formed as separate components. In some cases, the push rod 30 can be separable form the cap 46 to facilitate replacement of the push rod 30. The cap 46 includes a distal sleeve 48 that fits over the proximal end 36 of the push rod 30. The distal sleeve 48 includes a wall that extends towards the distal end 38 of the push rod 30, terminating before the distal end 38 of the push rod 30 (e.g., the wall of the distal sleeve 48 extends for a length smaller than the length of the push rod 30). The wall of the distal sleeve 48 can provide support to the push rod 30, but does not extend the full length of the push rod 30 to avoid obviating the heat-insulating properties of the push rod 30. An axial extension 51 extends proximally from the cap 46. The push rod 30 can be made of a refractory material or other heat-insulating material. The distal sleeve 48 can be made of any suitable metal.

The fastener 32 includes a distal abutment surface 52 and external threads 54. An axially aligned sleeve 56 extends from the distal side of the fastener 32 and is shaped to receive the axial extension 51 of the cap 46. The fastener 32 includes a tool receiving pattern, such as a hex pattern 58, on a proximal side.

The support assembly clamp plate 34 is installed on the outer casing 24 by the clamp plate fasteners 37. The cap 46 is seated on the push rod 30, and the push rod 30 is inserted into the aperture 35. The spring washers 28 are installed on the axial extension 51, and the axially aligned sleeve 56 is fitted over the end of the axial extension 51 so that the abutment surface 52 engages the proximal side of the closest spring washer 28. The opposite side of the washers 28 engages a shoulder surface 53 of the cap 46.

The fastener 32 is threaded, via the external threads 54, into internal threads 60 in the aperture 35. A tool (not shown) is fitted onto the tool receiving pattern 58, and the fastener 32 is driven into the aperture 35. The fastener 32 pushes the spring washers 28, which in turn press the push rod 30, via the cap 46, into contact with the refractory 22. The fastener 32 is tightened to press the push rod 30 into engagement, but not tight engagement that would cause full compression of the spring washers. The resiliency of the spring washers 28 keeps the push rod 30 resiliently pressed against the refractory 22, but the push rod can move inward, against the bias of the spring washers, as a result of expansion of the refractory 22. In some embodiments, the fastener 32 can be partly tightened so as to allow expansion and contraction of the refractory 22 relative to the outer casing 24.

As shown in FIG. 5, each of the support assemblies 26 is positioned between the outer casing 24 and the refractory 22 so that the support assemblies 26 apply forces to the refractory 22 to suspend the refractory 22 relative to the outer casing 24.

In some embodiments, the support assembly 26 is positioned so that the support assembly clamp plate 34 is attached to the outer casing 24, with the push rod 30 extending through the aperture 35 in the support assembly clamp plate 34 and an aperture in the outer casing 24 so that distal end 38 of the push rod 30 engages the refractory 22. Fastener 32 may be tightened to apply compressive torque that translates to a force sufficient to suspend the refractory 22 relative to the metal casing 24. In particular, the ends of each support assembly 26 generate equal and opposite forces to hold the refractory 22 in place relative to the metal casing 24. In this way, the support assemblies 26 apply a force to the refractory 22 to compress the refractory 22 in an axial direction.

As described above, spring washers 28 (sometimes referred to as Belleville washers) engage the push rod 30 and act as a spring to maintain a constant force on the lower surface of the refractory 22 regardless of the temperature changes and corresponding expansion or contraction of the outer casing 24 or the refractory 22. If the refractory 22 expands relative to the outer casing 24, applying compressive force to the support assembly 26, the spring washers 28 compress to allow limited movement of the push rod 30 to accommodate the expansion without a corresponding movement on the other end of the support assembly. Similarly, if the refractory 22 contracts relative to the outer casing 24, the spring washers 28 expand to allow limited movement of the push rod 30 inward toward the refractory to accommodate the compression without a corresponding movement on the other end of the support assembly.

In this way, the support assemblies 26 help maintain a constant force between the metal outer casing 24 and the refractory 22 as the outer casing 24 expands and contracts as the refractory 22 expands and contracts. As a result, the support assemblies 26 allow the curvilinear metal transfer device 10 to behave like an accordion and accommodate different expansion and contraction rates of the outer casing 24 and the refractory 22. Support assemblies 26 accomplish this by keeping the refractory 22 in tension with respect to the outer metal casing 24 and allowing for selective expansion and compression of the refractory 22 relative to the outer metal casing 24.

Specifically, one end of each support assembly 26 pushes against the outer casing 24 and the other end of the support assembly 26 pushes against the refractory 22 to suspend the refractory 22 relative to the outer casing 24. The one or more spring washers 28 translates forces applied from either the outer casing 24 or the refractory 22 to the push rods 30 to ensure that the refractory 22 is suspended relative to the outer casing regardless of temperature fluctuations.

Figure 13:
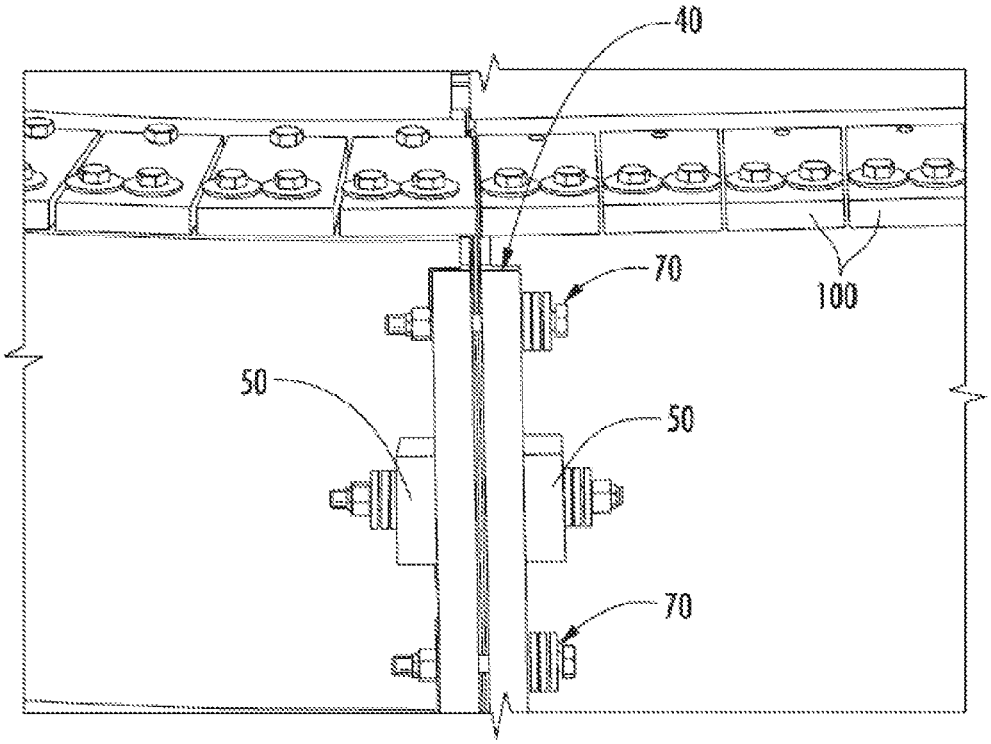
FIG. 13 illustrates the connection of two sections of a curvilinear metal transfer device using various compression assemblies according to one embodiment.

As shown in FIG. 2, various joints 40 are formed where sections 25 of the curvilinear metal transfer device 10 abut one another. FIG. 13 shows a side view of one section 25 of a metal transfer device such as metal transfer device 10 and the joint 40 where two sections 25 are joined. If desired, a series of compression assemblies 50 may be included along these joints 40 to account for the expansion and contraction of the joint as the temperature of the metal transfer device 10 changes. In this way, if the inner wall 21 abutting the inner side of the joint 40 expands less than the outer wall 23 abutting the outer side of the joint 40, the compression assemblies account for such uneven expansion.

Figure 10:
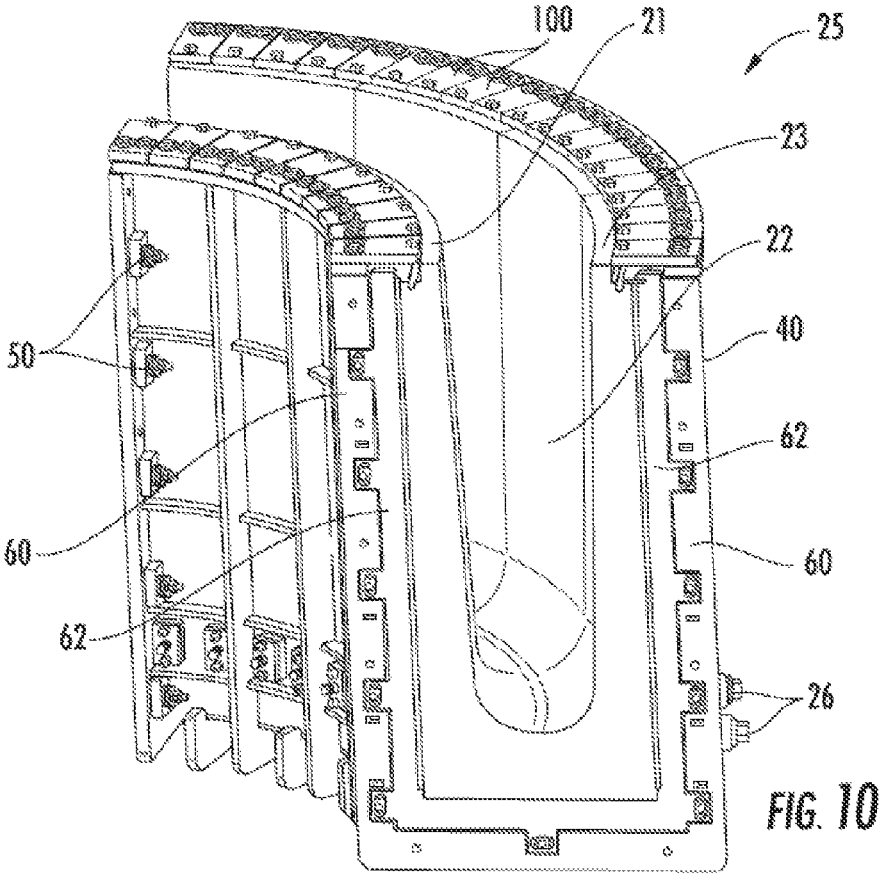
FIG. 10 is an end perspective view of a section of a curvilinear metal transfer device according one embodiment.
Figure 11:
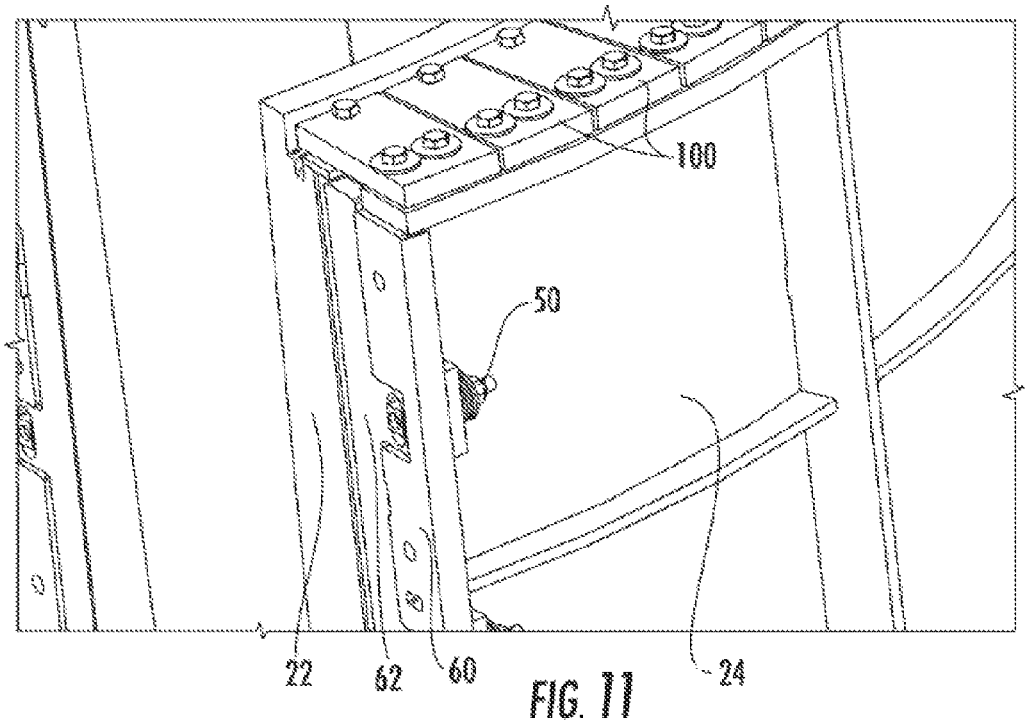
FIG. 11 is a close-up partial perspective view of the end of the section of FIG. 10.
Figure 12:
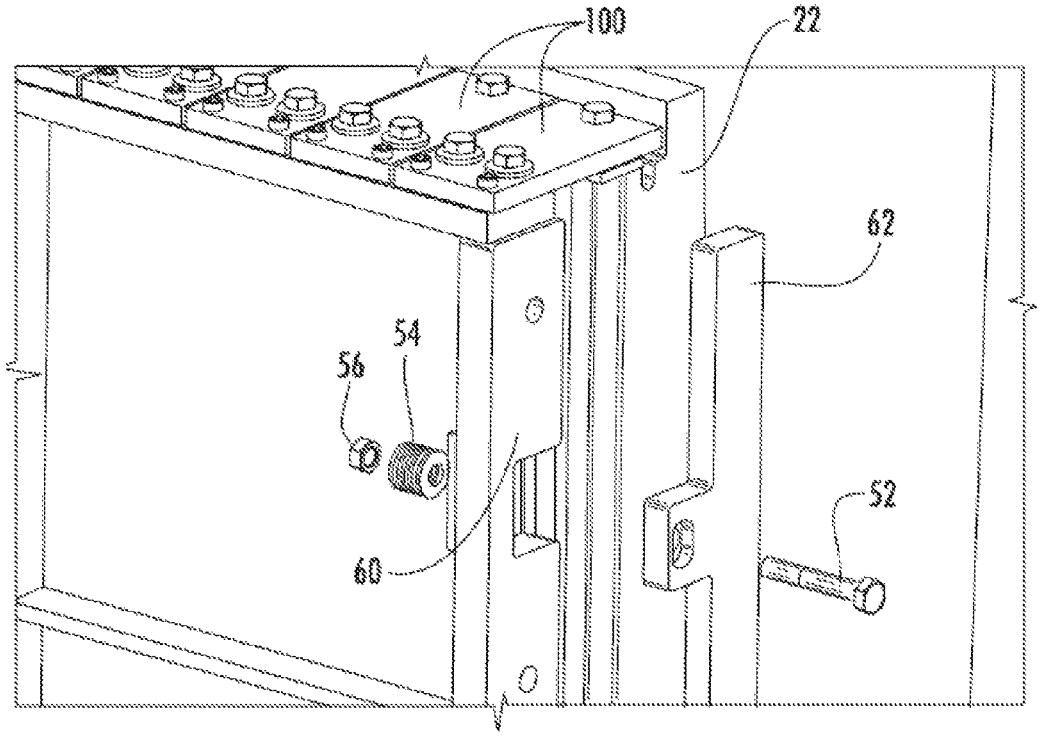
FIG. 12 is an exploded view of a compression flange with a compression assembly according to one embodiment.
Figure 17:
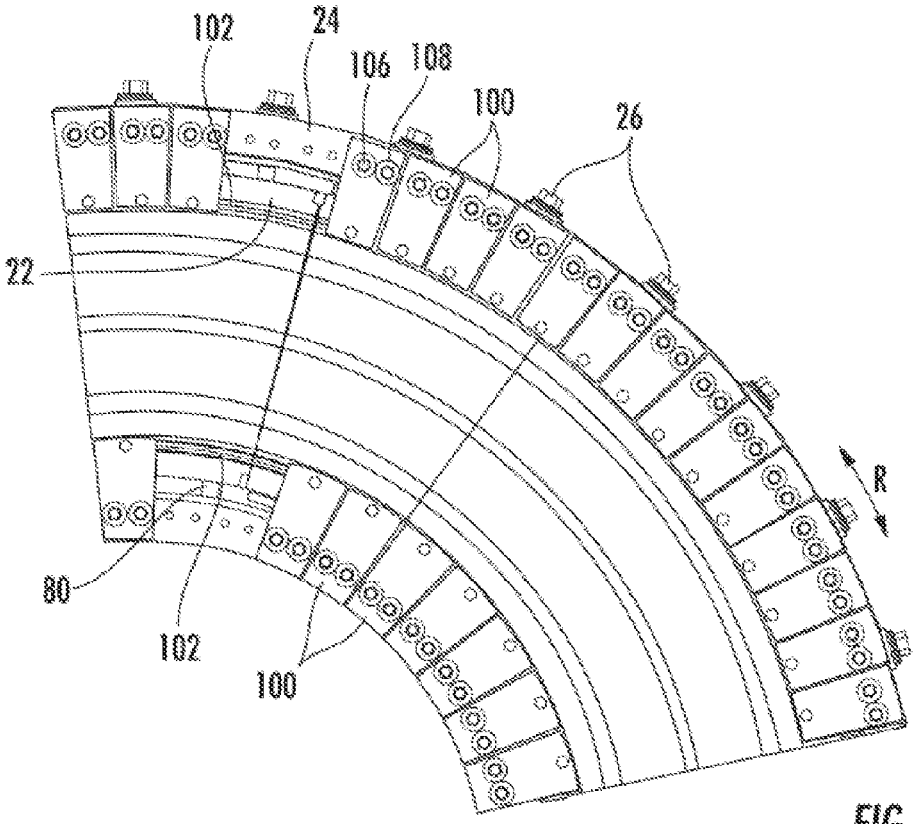
FIG. 17 is a top view of a portion of the curvilinear metal transfer device of FIG. 10.
Figure 18:
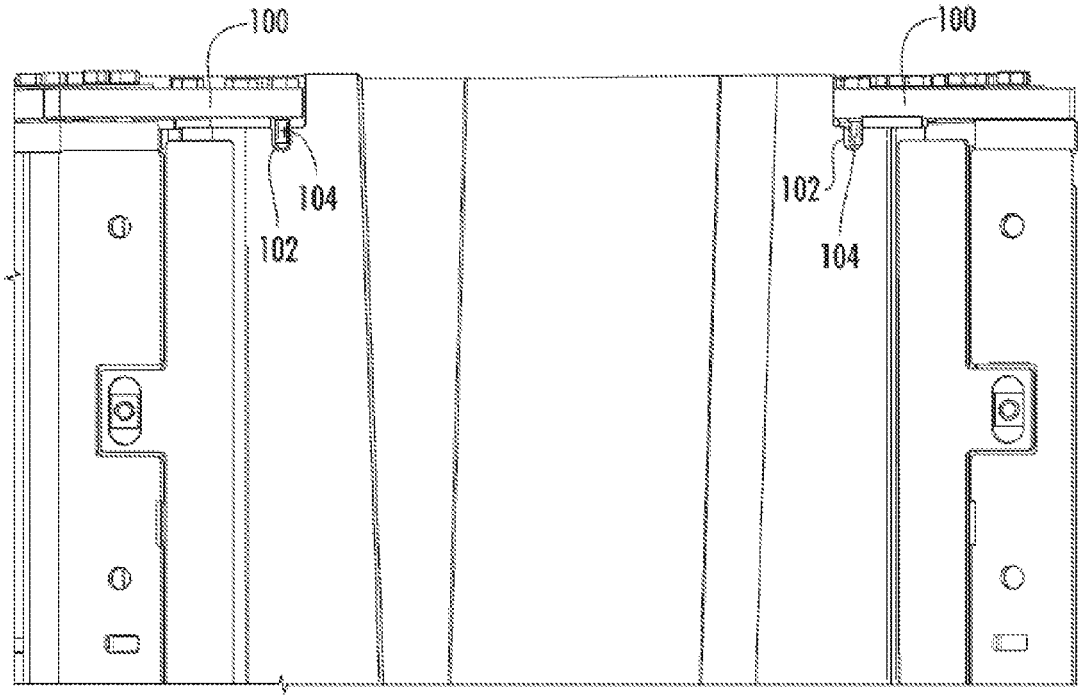
FIG. 18 is a partial section view of a portion of the curvilinear metal transfer device of FIG. 10.

Specifically, as shown in FIG. 12, each side of joint 40 includes a stationary flange 60 that is welded or otherwise attached to the outer casing 24 and a compression flange 62 that moves relative to stationary flange 60. In some embodiments, compression flange 62 abuts refractory 22 as illustrated in FIG. 10 and is compressed via compression assemblies 50. Compression flanges 62 provide compression against the refractory 22 on both ends of each section 25 in the circumferential or arc-radial direction and help eliminate or reduce any gaps between the refractory 22 sections. Each compression assembly 50 can include a fastener 52, a locking nut 56, and one or more spring washers 54. The body of the fastener 52 can pass through an aperture in the compression flange 62 and an aperture in the stationary flange 60. A flange of a head of the fastener 52 can abut a surface of the compression flange 62. The one or more spring washers 54 can be placed around the body of the fastener 52 on the opposite side of the stationary flange 60 from the head of the fastener 52 and secured on the body of the fastener 52 by the locking nut 56. In some cases, the compression assembly 50 can include more, fewer, or different elements that maintain compression of the compression flange 62 against the refractory 22 while allowing for limited movement of the compression flanges 62 (e.g., due to expansion of the refractory 22). The fastener 52 can be a bolt, although other fastening devices can be used. In some cases, the locking nut 56 can be replaced by another device to retain the one or more spring washers 54 on the fastener 52. In some cases, other spring-like devices can be used in place of the one or more spring washers 54. The compression assembly 50 can provide compressive force to secure the ends of the refractory 22 while allowing for limited movement of the compression flanges 62. Specifically, as fastener 52 of compression assembly 50 (FIG. 12) is tightened relative to locking nut 56, the compression flange 62 compresses against the refractory 22 and pulls the refractory 22 into compression in a circumferential direction R (see FIG. 17). One or more spring washers 54 (which may be Belleville washers in some embodiments) compress to allow limited movement of the compression flanges 62.

Figure 14:
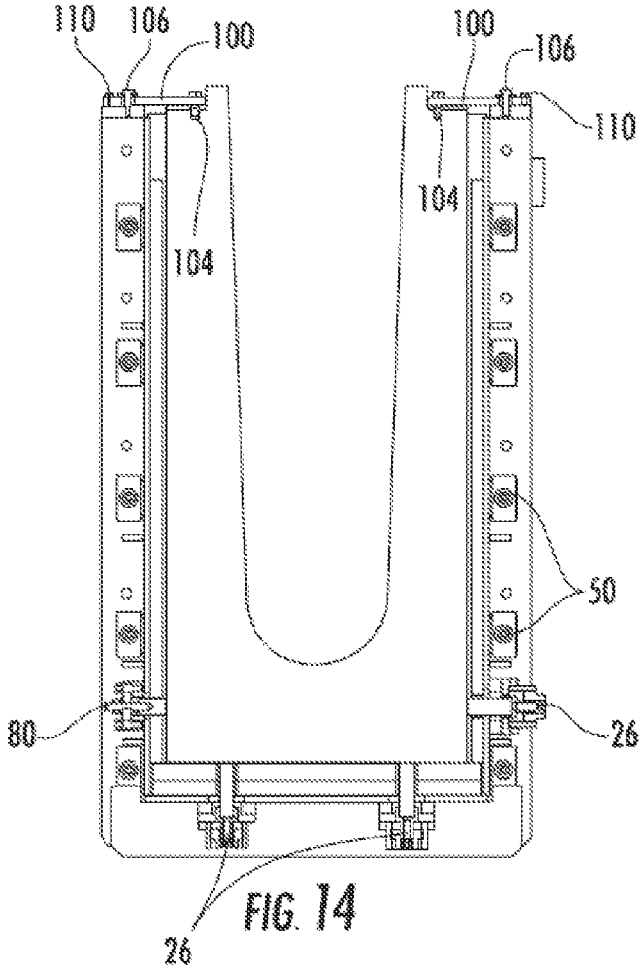
FIG. 14 is a section view of the transfer device of FIG. 10, taken at support and jackscrew assembly locations.
Figure 15:
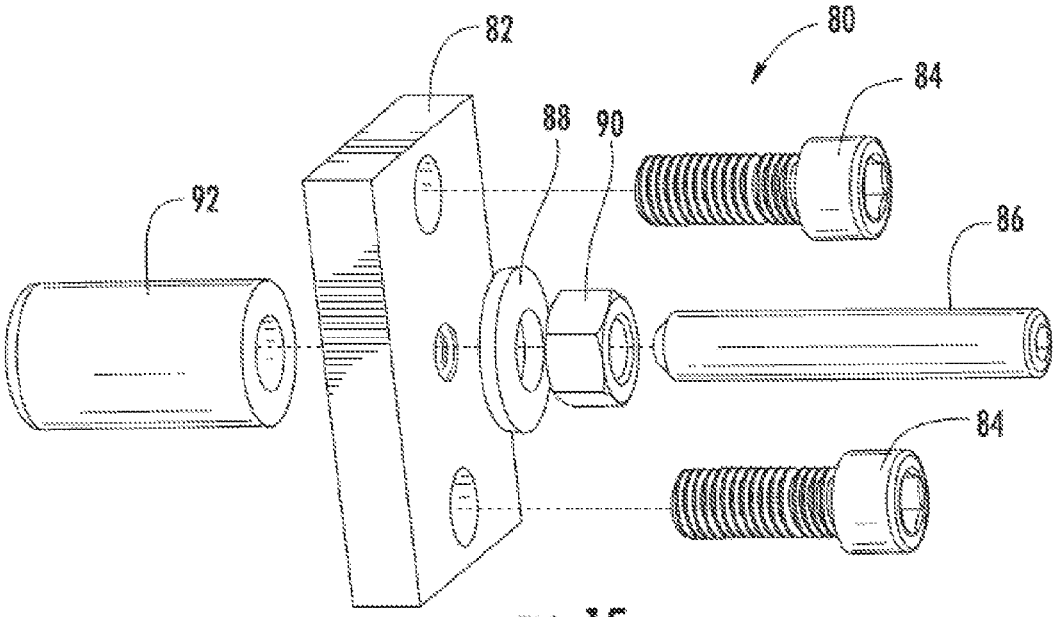
FIG. 15 is an exploded view of a support assembly according to one embodiment.
Figure 16:
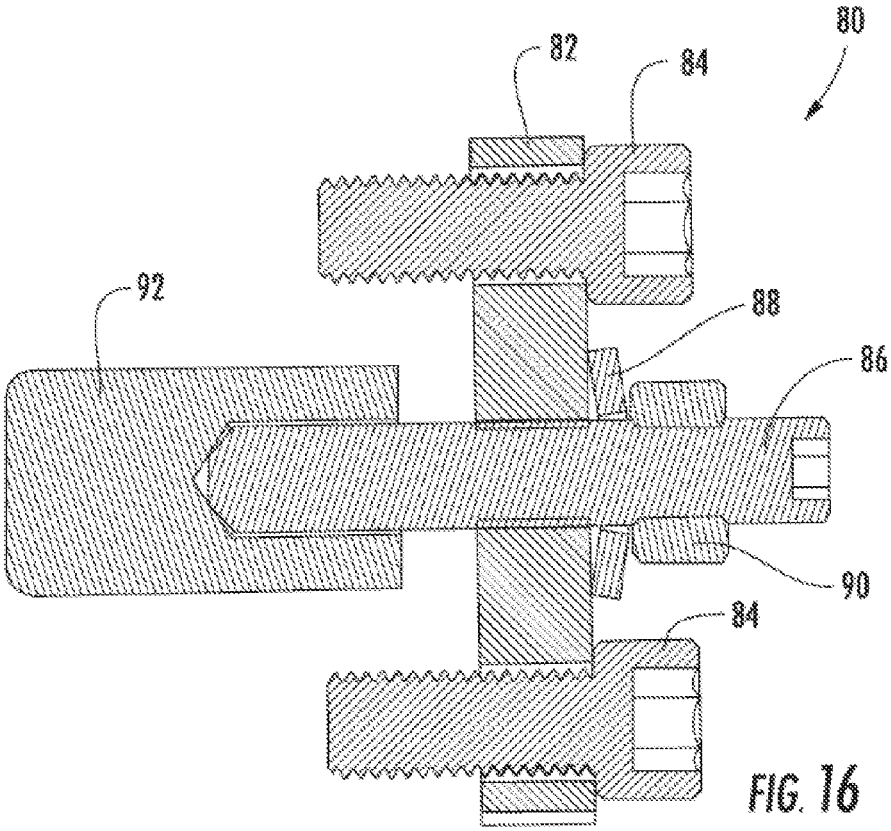
FIG. 16 is an assembled section view of the support assembly of FIG. 15.

As shown in FIG. 13, each joint 40 can include one or more compression assemblies 50 and one or more compression assemblies 70 that compress the sections 25 together at the joints 40 using spring washers and fasteners. As shown in FIGS. 14-16, the curvilinear metal transfer device 10 may also include a plurality of support assemblies 80, which may be jackscrew assemblies and which may include a base 82, one or more fasteners 84, an adjustment setscrew 86, one or more spring washers 88, a locking nut 90, and a cap 92.

As shown in FIGS. 10-14 and 17-19, metal transfer device 10 may include a plurality of vertical compression clamp plates 100 arranged along the top of the device 10. Vertical compression clamp plates 100 apply a generally vertical compression to the refractory 22. An upper portion of the refractory 22 (or other suitable portion of the metal transfer device 10) may include one or more grooves 102 (FIGS. 17-18) that receive a locator pin 104 of each vertical compression clamp plate 100. Each vertical compression clamp plate 100 includes a fastener (such as vertical compression clamp plate fastener 106) and one or more spring washers (such as Belleville washers 108) to allow for a certain amount of generally vertical movement (expansion and compression) between the clamp plate 100 and the top of the device 10. Each clamp plate 100 may also include one or more leveling screws 110 (FIG. 14). When vertical compression clamp plate fasteners 106 are tightened, vertical compression clamp plates 100 compress against the refractory 22 and help hold the refractory 22 in place during heat up and thermal cycling. Locator pins 104, when received within grooves 102, help hold the refractory 22 in place and maintain its alignment, particularly as compression flanges 62 are compressed. In some embodiments, a portion of the refractory (such as portion 66 in FIG. 22) extends above the vertical compression clamp plates 100 to protect the vertical compression clamp plates during heat up and thermal cycling.

The various support and compression assemblies and clamp plates disclosed above allow for selective compression and expansion of the refractory 22 and outer casing 24 in various directions, including the generally vertical, generally horizontal, and radial/circumferential directions.

Figure 19:
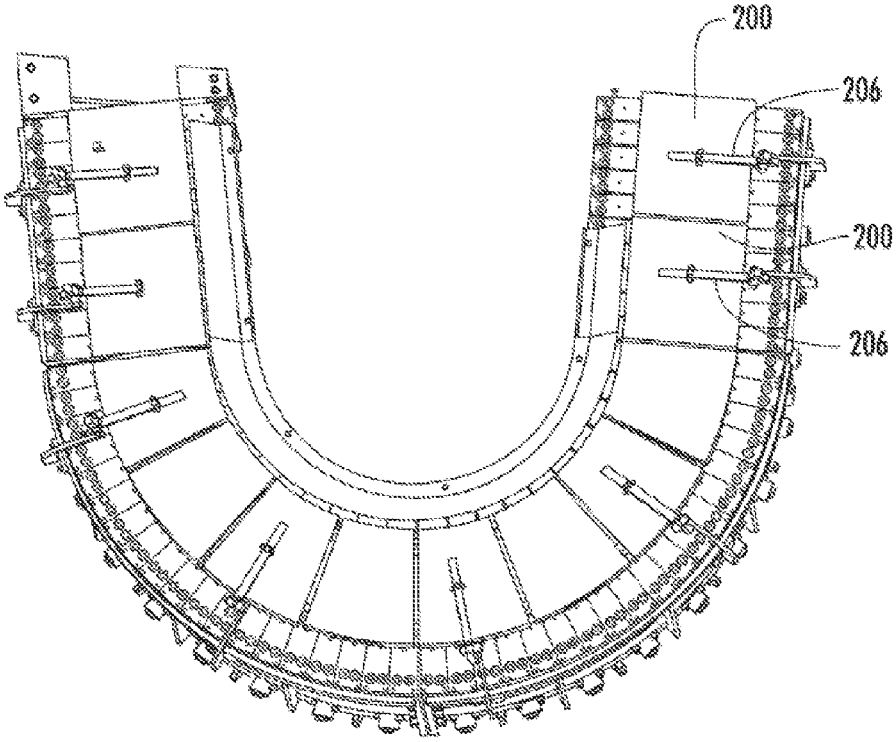
FIG. 19 is a top view of a curvilinear metal transfer device according to one embodiment, shown with lids.

As shown in FIGS. 19-23, also disclosed are thermally resistant lids 200 that may be used to cover the metal transfer device. In some embodiments, lids 200 are heavy enough to overcome the positive pressures exerted by the furnace, although clamps may be used to counteract these pressures if they exceed the mass of the lids. As shown in FIG. 19, in some embodiments, a lid 200 is used to cover each section 25 of the metal transfer device, although other arrangements may be used. In some embodiments, the dimensions of the lid 200 correspond to the dimensions of a section 25.

Figure 20:
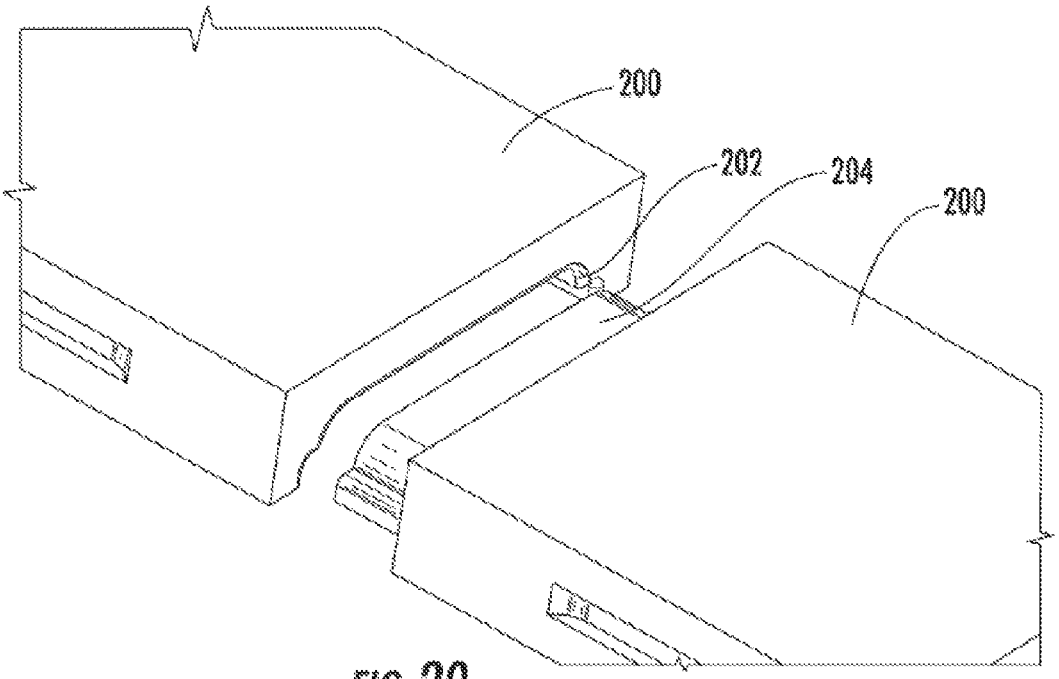
FIG. 20 is a top perspective view showing two lids positioned with respect to one another.
Figure 21:
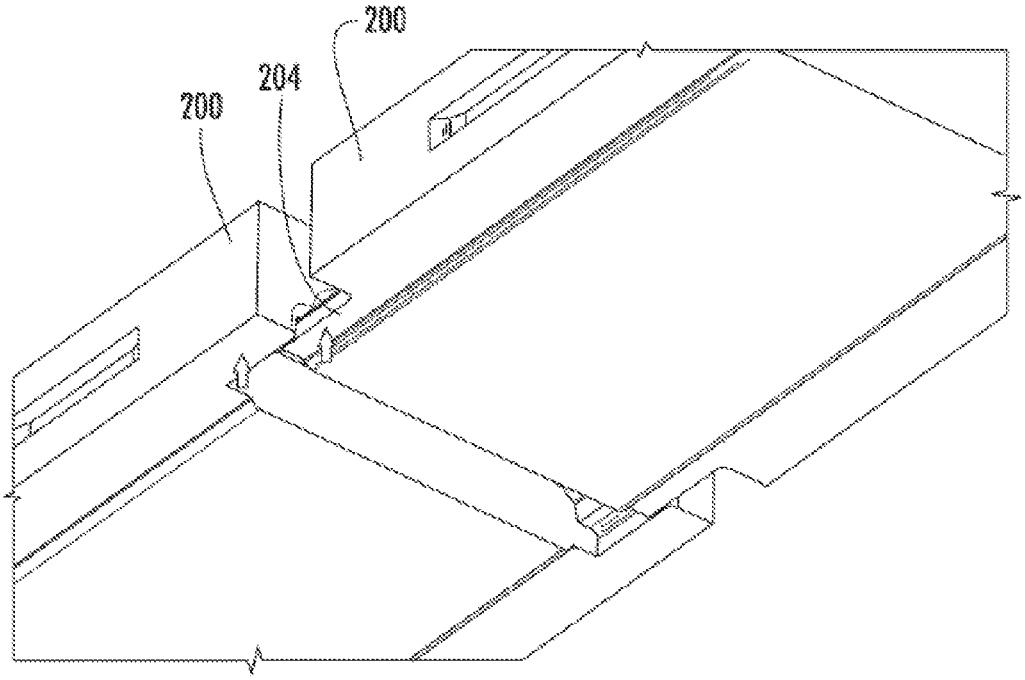
FIG. 21 is a bottom perspective view of the lids of FIG. 20, shown as the lids engage with one another.

Lids 200 are configured to nest together and interlock with one another as shown in FIGS. 20-21. Specifically, one end of each lid may include a cavity 202 dimensioned to receive a protrusion 204 of an adjacent lid. The lids 200 are configured to interlock together so that one lid can be removed without requiring that the other lids also be removed. In some embodiments, the lids 200 nest between the vertical compression clamp plates 100 and, when engaged together as in FIG. 22, are configured to create a seal to prevent hot gases and latent heat of the molten metal from escaping from the metal transfer device.

Figure 22:
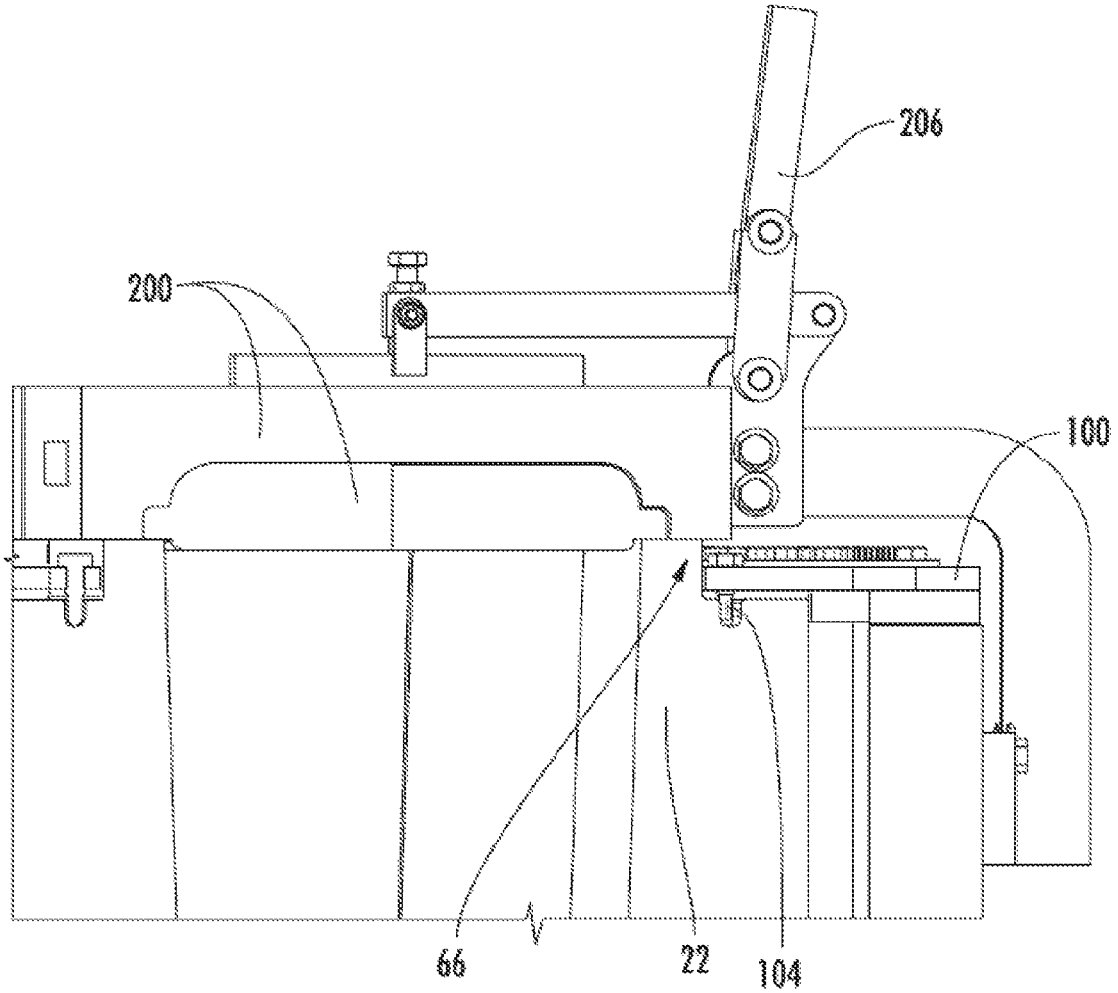
FIG. 22 is a section view showing two engaged lids covering a portion of a metal transfer device and showing a lid clamp in the lowered position.
Figure 23:
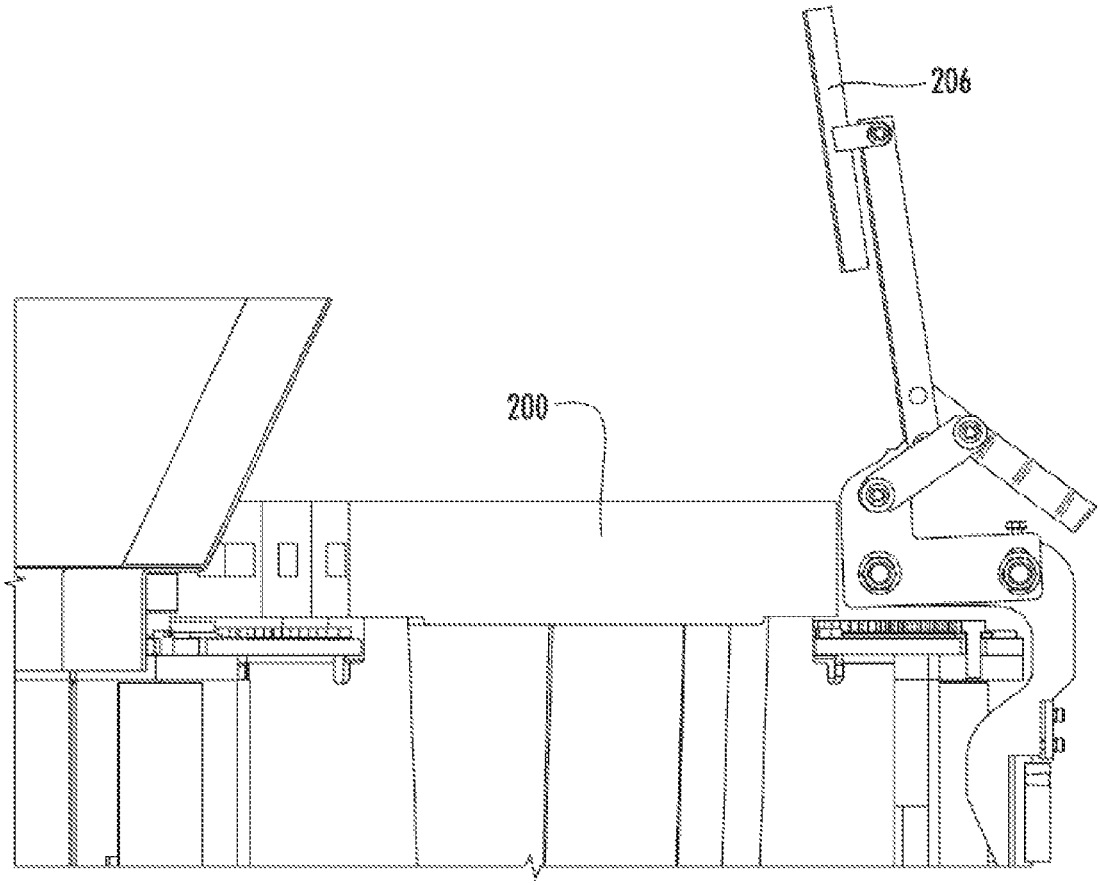
FIG. 23 is a section view showing two engaged lids covering a portion of a metal transfer device and showing a lid clamp in the raised position.

As shown in FIGS. 22-23, a clamp 206 may be used to help keep lids 200 in place. FIG. 22 illustrates the clamp 206 in the lowered position and FIG. 23 illustrates the clamp 206 in the raised position. FIG. 19 illustrate a plurality of nested lids 200. Clamps 206 may be included on one or more of the lids 200; due to the nested nature of the lids, a single clamp 206 may be sufficient to hold down one or more neighboring lids as well as the lid with which clamp 206 is associated.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

As used below, any reference to a series of examples is to be understood as a reference to each of those examples disjunctively (e.g., "Examples 1-4" is to be understood as "Examples 1, 2, 3, or 4").

Example 1 is a curvilinear metal transfer device comprising an outer casing comprising a curvilinear inner wall and a curvilinear outer wall, wherein the outer casing includes individual sections that are joined together at casing joints by a plurality of compression assemblies; and an inner refractory positioned within the outer casing and comprising a curvilinear inner wall and a curvilinear outer wall, wherein the inner refractory includes sections that abut one another at refractory joints, and wherein the compression assemblies are configured to account for lesser expansion of the curvilinear inner wall of the inner refractory than the curvilinear outer wall of the inner refractory.

Example 2 is the curvilinear metal transfer device of example 1, wherein each of the casing joints comprises a first side proximate the curvilinear inner wall of the inner refractory and a second side proximate the curvilinear outer wall of the inner refractory, and wherein the first side and the second side each comprise a stationary flange attached to the outer casing and a compression flange that is movable relative to the stationary flange.

Example 3 is the curvilinear metal transfer device of example 2, wherein the compression flanges are compressible via the plurality of compression assemblies in a circumferential direction to reduce gaps between the sections.

Example 4 is the curvilinear metal transfer device of examples 1-3, wherein each of the plurality of compression assemblies includes a fastener, a locking nut, and one or more spring washers that allow limited movement of the compression flanges.

Example 5 is the curvilinear metal transfer device of examples 1-4 further comprising a plurality of clamp plates arranged along and compressibly fastened to a top of the outer casing, wherein each of the plurality of clamp plates is operably engaged with an upper portion of the inner refractory to help maintain an alignment of the inner refractory.

Example 6 is the curvilinear metal transfer device of example 5, wherein each of the plurality of clamp plates includes a locator pin receivable within a groove of the upper portion of the inner refractory.

Example 7 is the curvilinear metal transfer device of examples 5 or 6, wherein each of the plurality of clamp plates includes a fastener and one or more spring washers to allow for a limited amount of vertical movement between the clamp plate and the inner refractory.

Example 8 is the curvilinear metal transfer device of example 1-7, wherein the inner refractory is supported within the outer casing by a plurality of compressible support assemblies, each of the plurality of compressible support assemblies comprising a push rod having a proximal end and an opposed distal end that is configured to bear against the inner refractory, the push rod made of a heat-insulating material; a cap with a shoulder surface and a distal sleeve extending from the shoulder surface that fits over the proximal end of the push rod, wherein a wall of the distal sleeve extends for a length smaller than a length of the push rod; a plate configured to mount to the outer casing and defining an aperture through which the push rod extends; a fastener attached to the plate proximal of the push rod, the fastener having a distal abutment surface; and at least one spring washer mounted on the cap and configured to engage the shoulder surface of the cap and the distal abutment surface of the fastener so as to bias the push rod against the inner refractory.

Example 9 is the curvilinear metal transfer device of examples 1-8, further comprising a plurality of lids for covering the inner refractory, wherein each of the plurality of lids includes a first end and a second end, wherein the first end comprises a cavity and the second end comprises a protrusion receivable within the cavity, wherein the plurality of lids nest together in an arrangement such that the protrusion of the second end of one of the plurality of lids interlocks with the cavity of the first end of another one of the plurality of lids, and wherein the arrangement allows one of the plurality of lids to be removed without requiring that all of the plurality of lids be removed.

Example 10 is a curvilinear metal transfer device comprising an outer casing comprising a curvilinear inner wall and a curvilinear outer wall; and an inner refractory positioned within the outer casing and comprising a curvilinear inner wall and a curvilinear outer wall, wherein a plurality of lids are configured to nest together to generally cover a top of the curvilinear metal transfer device.

Example 11 is the curvilinear metal transfer device of example 10, wherein each of the plurality of lids is dimensioned to correspond to dimensions of a section of the inner refractory.

Example 12 is the curvilinear metal transfer device of examples 10 or 11, wherein each of the plurality of lids includes a first end and a second end, wherein the first end comprises a cavity and the second end comprises a protrusion receivable within the cavity.

Example 13 is the curvilinear metal transfer device of examples 10-12, further comprising a clamp to help keep one or more of the plurality of lids in position.

Example 14 is the curvilinear metal transfer device of example 10-13, wherein the plurality of lids nest together in an arrangement such that a protrusion of a second end of one of the plurality of lids interlocks with a cavity of a first end of another one of the plurality of lids, wherein the arrangement allows one of the plurality of lids to be removed without requiring that all of the plurality of lids be removed.

Example 15 is the curvilinear metal transfer device of examples 10-14, wherein individual sections of the outer casting are joined together at casing joints by a plurality of compression assemblies, wherein individual sections of the refractory abut one another at refractory joints, and wherein the compression assemblies are configured to account for lesser expansion of the curvilinear inner wall of the inner refractory than the curvilinear outer wall of the inner refractory.

Example 16 is a curvilinear metal transfer device comprising an outer casing comprising a curvilinear inner wall and a curvilinear outer wall, wherein the outer casing includes individual sections that are joined together at casing joints; an inner refractory positioned within the outer casing and comprising a curvilinear inner wall and a curvilinear outer wall, wherein the inner refractory includes sections that abut one another at refractory joints, wherein the inner refractory is supported within the outer casing by a plurality of compressible support assemblies, each of the plurality of compressible support assemblies comprising: a push rod having a proximal end and an opposed distal end that is configured to bear against the inner refractory, the push rod made of a heat-insulating material; a plate configured to mount to the outer casing and defining an aperture through which the push rod extends; a fastener attached to the plate proximal of the push rod, the fastener having a distal abutment surface; and at least one spring washer positioned between the push rod and the fastener so as to bias the push rod against the inner refractory.

Example 17 is the curvilinear metal transfer device of example 16, wherein each of the plurality of compressible support assemblies further comprises a cap with a shoulder surface and a distal sleeve extending from the shoulder surface that fits over the proximal end of the push rod, wherein a wall of the distal sleeve extends for a length smaller than a length of the push rod, and wherein the at least one spring washer is mounted on the cap to engage the shoulder surface of the cap and the distal abutment surface of the fastener.

Example 18 is the curvilinear metal transfer device of example 17, wherein the fastener comprises an axially aligned sleeve shaped to receive an extension of the cap.

Example 19 is the curvilinear metal transfer device of examples 16-18, wherein the fastener is configured to compress the at least one spring washer and press the push rod into contact with the inner refractory.

Example 20 is the curvilinear metal transfer device of examples 16-19, wherein the individual sections of the outer casing are joined together at the casing joints by a plurality of compression assemblies, and wherein the compression assemblies are configured to account for lesser expansion of the curvilinear inner wall of the inner refractory than the curvilinear outer wall of the inner refractory.

The invention claimed is:

1. A curvilinear metal transfer device comprising:

an outer casing comprising a curvilinear inner wall and a curvilinear outer wall, wherein the outer casing includes individual sections that are joined together at casing joints by a plurality of compression assemblies; and an inner refractory positioned within the outer casing and comprising a curvilinear inner wall and a curvilinear outer wall, wherein the inner refractory includes sections that abut one another at refractory joints, wherein the compression assemblies are compressible in circumferential directions to reduce gaps between the sections of the inner refractory, and wherein the compression assemblies are configured to account for lesser expansion of the curvilinear inner wall of the inner refractory than the curvilinear outer wall of the inner refractory.

2. The curvilinear metal transfer device of claim 1, wherein each of the casing joints comprises a first side proximate the curvilinear inner wall of the inner refractory and a second side proximate the curvilinear outer wall of the inner refractory, and wherein the first side and the second side each comprise a stationary flange attached to the outer casing and a compression flange that is movable relative to the stationary flange.

3. The curvilinear metal transfer device of claim 2, wherein each of the plurality of compression assemblies includes a fastener, a locking nut, and one or more spring washers that allow limited movement of the compression flanges.

4. The curvilinear metal transfer device of claim 1, further comprising a plurality of clamp plates arranged along and compressibly fastened to a top of the outer casing, wherein each of the plurality of clamp plates is operably engaged with an upper portion of the inner refractory to help maintain an alignment of the inner refractory.

5. The curvilinear metal transfer device of claim 4, wherein each of the plurality of clamp plates includes a locator pin receivable within a groove of the upper portion of the inner refractory.

6. The curvilinear metal transfer device of claim 4, wherein each of the plurality of clamp plates includes a fastener and one or more spring washers to allow for a limited amount of vertical movement between the clamp plate and the inner refractory.

7. The curvilinear metal transfer device of claim 1, wherein the inner refractory is supported within the outer casing by a plurality of compressible support assemblies, each of the plurality of compressible support assemblies comprising:

a push rod having a proximal end and an opposed distal end that is configured to bear against the inner refractory, the push rod made of a heat-insulating material;

a cap with a shoulder surface and a distal sleeve extending from the shoulder surface that fits over the proximal end of the push rod, wherein a wall of the distal sleeve extends for a length smaller than a length of the push rod;

a plate configured to mount to the outer casing and defining an aperture through which the push rod extends;

a fastener attached to the plate proximal of the push rod, the fastener having a distal abutment surface; and at least one spring washer mounted on the cap and configured to engage the shoulder surface of the cap and the distal abutment surface of the fastener so as to bias the push rod against the inner refractory.

8. The curvilinear metal transfer device of claim 1, further comprising:

a plurality of lids for covering the inner refractory, wherein each of the plurality of lids includes a first end and a second end, wherein the first end comprises a cavity and the second end comprises a protrusion receivable within the cavity, wherein the plurality of lids nest together in an arrangement such that the protrusion of the second end of one of the plurality of lids interlocks with the cavity of the first end of another one of the plurality of lids, and wherein the arrangement allows one of the plurality of lids to be removed without requiring that all of the plurality of lids be removed.

9. A curvilinear metal transfer device of claim 1, wherein a plurality of lids are configured to nest together to generally cover a top of the curvilinear metal transfer device.

10. The curvilinear metal transfer device of claim 9, wherein each of the plurality of lids is dimensioned to correspond to dimensions of a section of the inner refractory.

11. The curvilinear metal transfer device of claim 9, wherein each of the plurality of lids includes a first end and a second end, wherein the first end comprises a cavity and the second end comprises a protrusion receivable within the cavity.

12. The curvilinear metal transfer device of claim 11, further comprising a clamp to help keep one or more of the plurality of lids in position.

13. The curvilinear metal transfer device of claim 9, wherein the plurality of lids nest together in an arrangement such that a protrusion of a second end of one of the plurality of lids interlocks with a cavity of a first end of another one of the plurality of lids, wherein the arrangement allows one of the plurality of lids to be removed without requiring that all of the plurality of lids be removed.

14. The curvilinear metal transfer device of claim 9, wherein individual sections of the outer casting are joined together at casing joints by a plurality of compression assemblies, wherein individual sections of the refractory abut one another at refractory joints, and wherein the compression assemblies are configured to account for lesser expansion of the curvilinear inner wall of the inner refractory than the curvilinear outer wall of the inner refractory, wherein each of the casing joints comprises a first side proximate the curvilinear inner wall of the inner refractory and a second side proximate the curvilinear outer wall of the inner refractory, and wherein the first side and the second side each comprise a stationary flange attached to the outer casing and a compression flange that is movable relative to the stationary flange.

15. A curvilinear metal transfer device of claim 1, wherein the inner refractory is supported within the outer casing by a plurality of compressible support assemblies, each of the plurality of compressible support assemblies comprising:

- a push rod having a proximal end and an opposed distal end that is configured to bear against the inner refractory, the push rod made of a heat-insulating material;
- a plate configured to mount to the outer casing and defining an aperture through which the push rod extends;
- a fastener attached to the plate proximal of the push rod, the fastener having a distal abutment surface; and
- at least one spring washer positioned between the push rod and the fastener so as to bias the push rod against the inner refractory.

16. The curvilinear metal transfer device of claim 15, wherein each of the plurality of compressible support assemblies further comprises a cap with a shoulder surface and a distal sleeve extending from the shoulder surface that fits over the proximal end of the push rod, wherein a wall of the distal sleeve extends for a length smaller than a length of the push rod, and wherein the at least one spring washer is mounted on the cap to engage the shoulder surface of the cap and the distal abutment surface of the fastener.

17. The curvilinear metal transfer device of claim 16, wherein the fastener comprises an axially aligned sleeve shaped to receive an extension of the cap.

18. The curvilinear metal transfer device of claim 17, wherein the fastener is configured to compress the at least one spring washer and press the push rod into contact with the inner refractory.

19. The curvilinear metal transfer device of claim 15, wherein the individual sections of the outer casing are joined together at the casing joints by a plurality of compression assemblies, and wherein the compression assemblies are configured to account for lesser expansion of the curvilinear inner wall of the inner refractory than the curvilinear outer wall of the inner refractory.

* * * * *